US011289803B1

(12) United States Patent
Li et al.

(10) Patent No.: US 11,289,803 B1
(45) Date of Patent: Mar. 29, 2022

(54) ANTENNA ELEMENT AND ANTENNA

(71) Applicants: ROSENBERGER TECHNOLOGIES CO., LTD., Suzhou (CN); ROSENBERGER TECHNOLOGIES LLC, Budd Lake, NJ (US)

(72) Inventors: Yongzhong Li, Suzhou (CN); Xu Wang, Suzhou (CN); Tao Jiang, Suzhou (CN); Jing Sun, Suzhou (CN)

(73) Assignees: ROSENBERGER TECHNOLOGIES CO., LTD., Suzhou (CN); ROSENBERGER TECHNOLOGIES LLC, Budd Lake, NJ (US)

( * ) Notice: Subject to any disclaimer, the term of this patent is extended or adjusted under 35 U.S.C. 154(b) by 0 days.

(21) Appl. No.: 17/373,081

(22) Filed: Jul. 12, 2021

(30) Foreign Application Priority Data

Dec. 31, 2020 (CN) ..... 202023305741.0

(51) Int. Cl.

| | |
|---|---|
| ***H01Q 1/38*** | (2006.01) |
| ***H01Q 1/40*** | (2006.01) |
| ***H01Q 1/24*** | (2006.01) |
| ***H01Q 9/16*** | (2006.01) |
| ***H01Q 21/00*** | (2006.01) |

(52) U.S. Cl.
CPC ..... *H01Q 1/38* (2013.01); *H01Q 1/241* (2013.01); *H01Q 1/40* (2013.01); *H01Q 9/16* (2013.01); *H01Q 21/0006* (2013.01)

(58) Field of Classification Search
CPC ..... H01Q 1/38; H01Q 1/241; H01Q 1/40; H01Q 9/16; H01Q 21/0006
See application file for complete search history.

(56) References Cited

U.S. PATENT DOCUMENTS

| | | | | |
|---|---|---|---|---|
| 5,294,938 | A * | 3/1994 | Matsuo | H01Q 1/3275 343/829 |
| 6,025,812 | A * | 2/2000 | Gabriel | H01Q 1/523 343/797 |
| 2012/0062439 | A1* | 3/2012 | Liao | H01Q 1/526 343/841 |
| 2020/0303822 | A1* | 9/2020 | Yao | H01L 23/49816 |
| 2020/0412013 | A1* | 12/2020 | Liu | H01Q 21/24 |

* cited by examiner

*Primary Examiner* — Dieu Hien T Duong
(74) *Attorney, Agent, or Firm* — Anova Law Group, PLLC

(57) ABSTRACT

An antenna element includes a base body. The base body includes a plate portion, a support column, and a metal layer. The plate portion is formed by non-metallic material. The at least one support column, each of the support column is connected to the plate portion. The metal layer covers the base body.

20 Claims, 6 Drawing Sheets

ANTENNA ELEMENT AND ANTENNA

CROSS-REFERENCE TO RELATED APPLICATION

This application claims priority to Chinese Application No. 202023305741.0, filed on Dec. 31, 2020, the entire content of which is incorporated herein by reference.

TECHNICAL FIELD

The present disclosure generally relates to the communication technology field and, more particularly, to an antenna element and an antenna.

BACKGROUND

An existing antenna element is usually formed by using a metal formation process (e.g., metal die casting, sheet metal stamping, etc.). However, a large number of antenna elements are needed in a 5G large-scale array antenna, which results in the excessive cost and an excessive weight. In addition, the antenna element formed by processes of existing selective electroplating and laser direct structuring (LDS) needs to take into account the dielectric constant of a medium. When a composition of a base plate is adjusted, a difference in the dielectric constant occurs. Local electroplating will cause a size of an electroplating area to be inconsistent. Thus, a boundary of the electroplating area has sawtooth burrs. These problems will cause a difference in the radiofrequency performance of the antenna, especially in the 5G high frequency range.

SUMMARY

Embodiments of the present disclosure provide an antenna element including a base body. The base body includes a plate portion, a support column, and a metal layer. The plate portion is formed by non-metallic material. The support column, each of the at least one support column is connected to the plate portion. The metal layer covers the base body.

Embodiments of the present disclosure provide an antenna including a plurality of antenna elements. The plurality of antenna elements are arranged in an antenna element array. Each of the plurality of antenna elements includes a base body. The base body includes a plate portion, a support column, and a metal layer. The plate portion is formed by non-metallic material. The support column, each of the at least one support column is connected to the plate portion. The metal layer covers the base body.

In the present disclosure, the other features, characteristics, advantages, and benefits will become apparent through the detailed description in conjunction with the drawings.

DETAILED DESCRIPTION OF THE EMBODIMENTS

Embodiments of the present disclosure are described with reference to some accompanying drawings of the present disclosure. The accompanying drawings show specific embodiments of the present disclosure through examples. Exemplary embodiments are not intended to be exhaustive of all embodiments according to the present disclosure. Without departing from the scope of the present disclosure, other embodiments may be used, and structural modifications may be performed. Therefore, the following detailed description is not restrictive, and the scope of the present invention is defined by the appended claims.

The terms "including," "containing," and similar terms used in the specification should be understood as open terms, that is, "including/including but not limited to", which means that another content may also be included. The term "one embodiment" means "at least one embodiment." The term "another embodiment" means "at least one additional embodiment", etc.

Embodiments of the present disclosure are described in detail in connection with the accompanying drawings.

Figure 1:
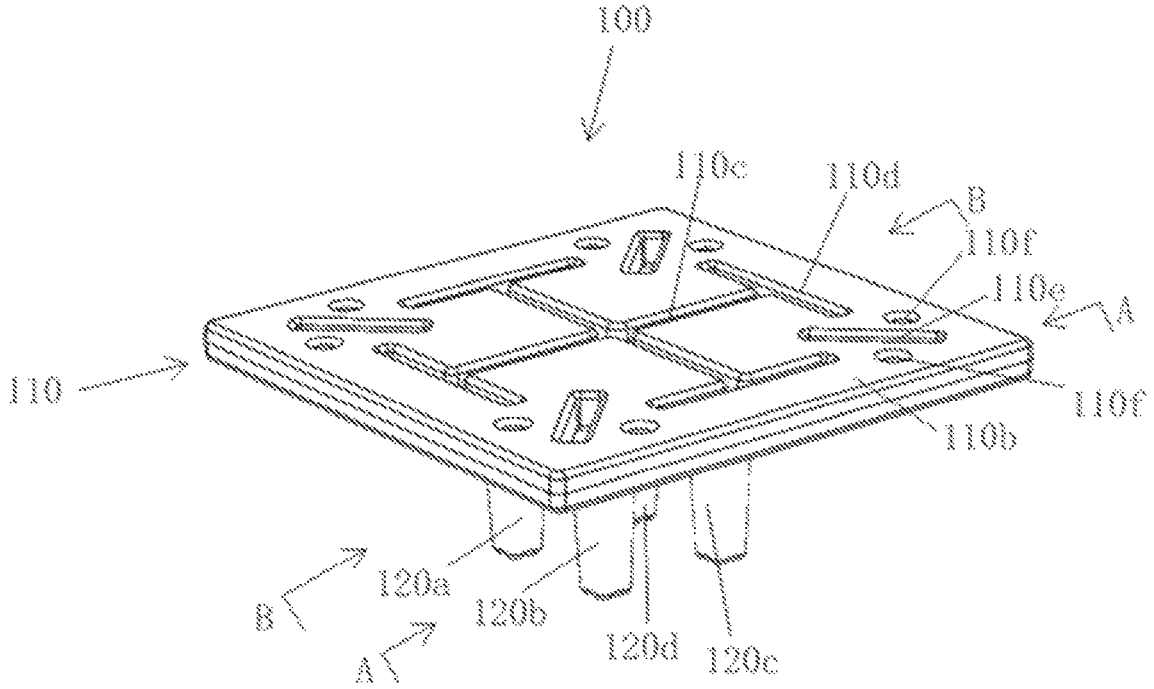
FIG. 1 is a schematic front perspective view of an antenna element according to some embodiments of the present disclosure.
Figure 2:
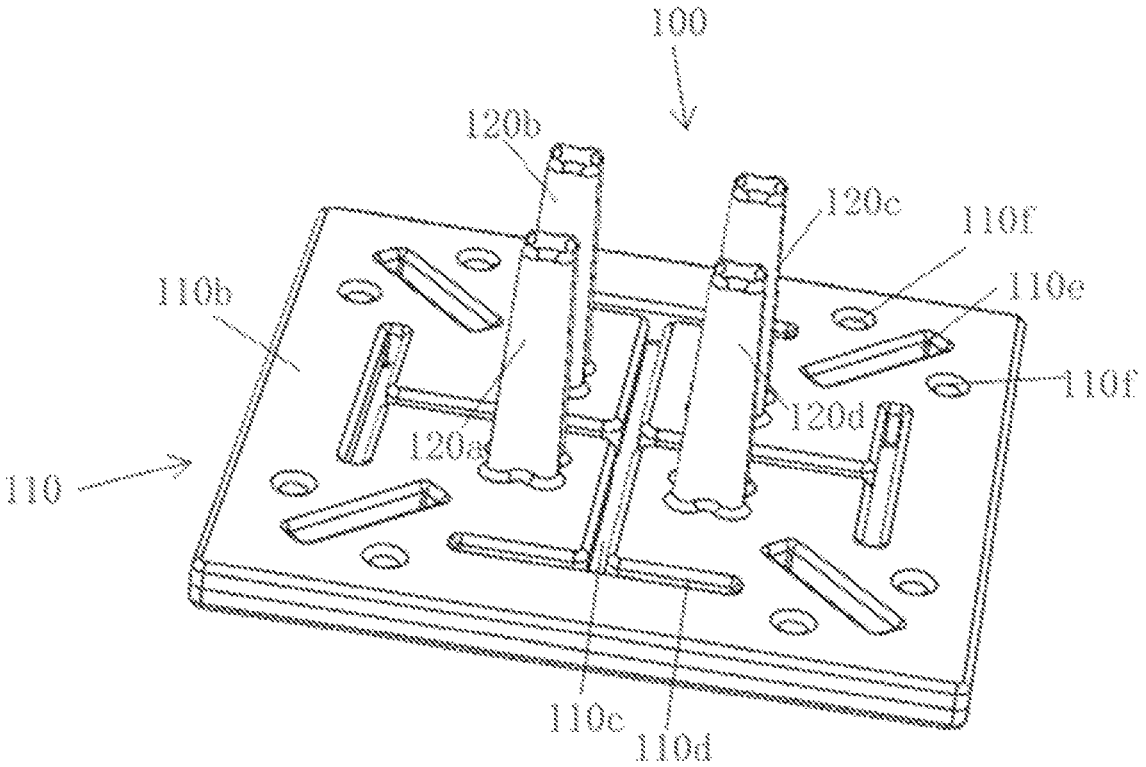
FIG. 2 is a schematic opposite side perspective view of the antenna element in FIG. 1.
Figure 3:
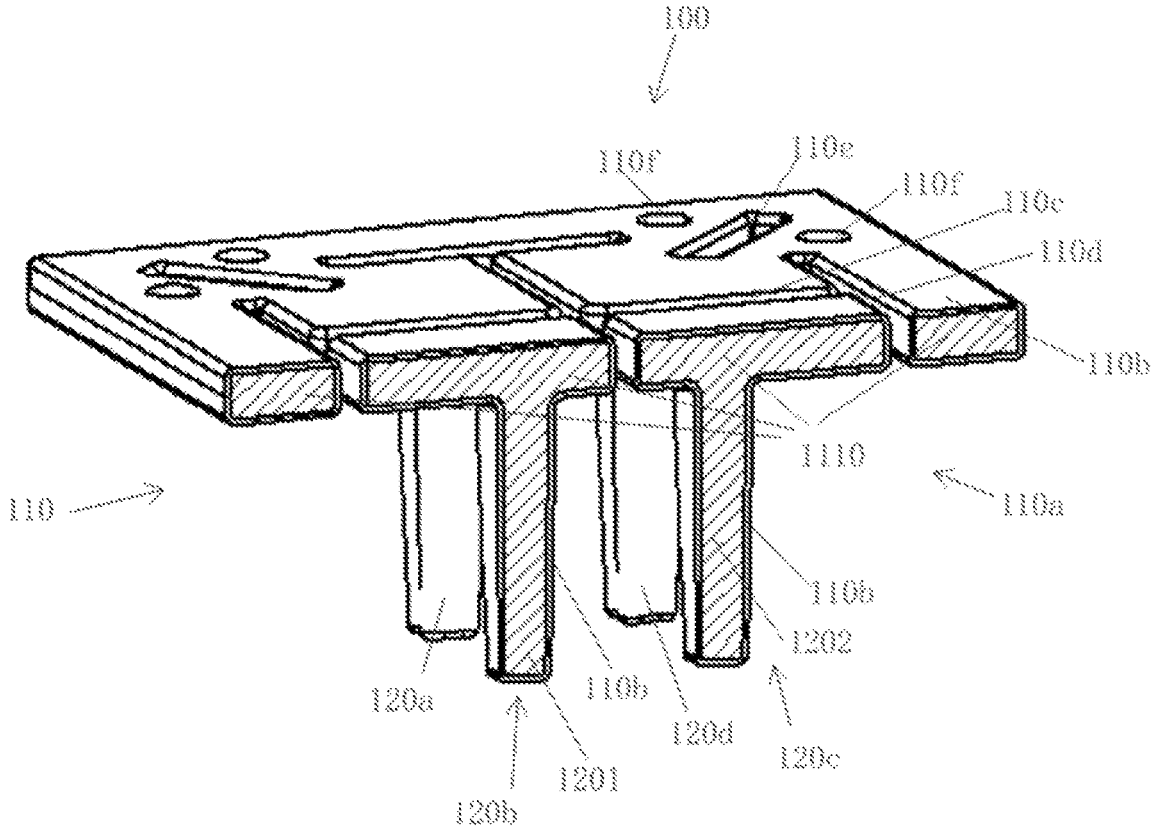
FIG. 3 is a schematic perspective view of the antenna element along an A-A direction in FIG. 1.

In the present disclosure, front, back, left, right, up, down, front end, rear end, left end, right end, upper, lower, left side, right side, longitudinal, horizontal, etc. are all relative concepts with reference to FIG. 1 to FIG. 3.

Figure 4:
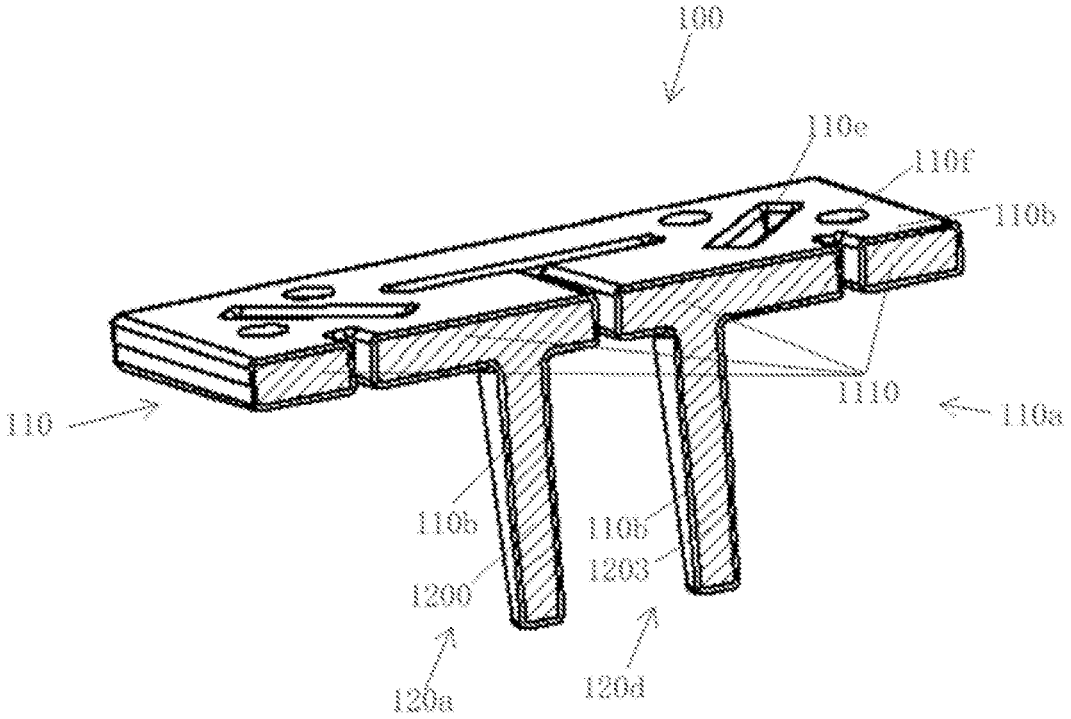
FIG. 4 is a schematic perspective view of the antenna element along a B-B direction in FIG. 1.

FIG. 1 is a schematic front perspective view of an antenna element 100 (the antenna element, as used herein, may refer to an antenna vibrator) according to some embodiments of the present disclosure. FIG. 2 is a schematic opposite side perspective view of the antenna element 100 according to some embodiments of the present disclosure. FIG. 3 and FIG. 4 are schematic perspective views showing a composition of the antenna element 10M by cutting FIG. 1.

As shown in FIG. 1 to FIG. 3, the antenna element 100 includes a base plate 110 and four support members 120*a*, 120*b*, 120*c*, and 120*d* that are connected to the antenna element base plate 110. The four support members 120*a*, 120*b*, 120*c*, and 120*d* may be configured to cause the antenna element base plate 110 to maintain a certain distance to a feeder member (e.g., a circuit board, not shown in the figure) and mount the antenna element base plate 110 at the feeder member. In some embodiments, each support member includes a first end and a second end opposite to each other. The first end of each support member is connected to the antenna element base plate 110. The second end of each support member is connected to the feeder member. In some embodiments, the second end of each support member may be connected to the feeder member by welding. Welding material may include low-temperature solder paste. In some embodiments, the second end of each support member may be connected to the feeder member by reflow welding. During the reflow welding, the low-temperature solder paste may be used for welding. As such, a furnace temperature and energy consumption reduction may be reduced. Although in some embodiments shown in FIGS. 1 to 3, four support members are included. In some other embodiments, the number of support members may be set as needed according to a power feeding manner and polarization, etc.

The antenna element 100 includes abase body 110*a* and a metal layer 110*b* that covers the base body 110*a*. The base body 110*a* may include high temperature resistant non-metallic material. In some embodiments, the non-metallic material may include plastic. The base body 110*a* may be formed through an integral injection molding manner. Then, electroplating may be performed on the base body 110*a* through a whole surface electroplating process. Thus, the metal layer 110*b* formed after the electroplating may cover the base body 110*a*. The material of the metal layer 110*b* may include any one or more of Copper (Cu), Silver (Ag), nickel (Ni), and Tin (Sn). The thickness of the metal layer 110*b* may be set as needed. In some other embodiments, the base body 110*a* may include any suitable non-metallic material except the plastic. The base body 110*a* may include the non-metallic material and have a relatively low dielectric loss. Thus, the impact of the dielectric constant of the base body 110*a* on the performance of the antenna element may not need to be taken into consideration. Meanwhile, the weight of the antenna element may be reduced to reduce the weight of the antenna. In addition, the cost may be further reduced. The electroplating may be performed on the surface of the base body 110*a* by using the whole surface electroplating process to form the metal layer 110*b* that covers the base body 110*a*. On one hand, the whole surface electroplating process may ensure the dimension precision of the antenna element and relatively high smoothness of the surface of the antenna element to enhance the consistency of the performance of the antenna element. As such, the antenna may have a better radiofrequency performance. On another hand, the cost of the whole surface electroplating process may be relatively low.

The base body 110*a* includes a plate portion 1110 and four support columns 1200, 1201, 1202, and 1203 connected to the plate portion 1110. In some embodiments, the plate portion 1110 and the four support columns 1200, 1201, 1202, and 1203 may be formed by plastic. The plate portion 1110 and the four support columns 1200, 1201, 1202, and 1203 may be formed through an integral injection molding manner. In some other embodiments, the plate portion 1110 and the four support columns 1200, 1201, 1202, and 1203 may be connected by another connection manner.

The antenna element base plate 110 includes the plate portion 1110 and the portion of the metal layer 110*b* that covers the plate portion 1110. The four support columns 1200, 1201, 1202, and 1203 and the portion of the metal layer 110*b* that covers the corresponding support columns form the four support members 120*a*, 120*b*, 120*c*, and 120*d*.

In some other embodiments, the antenna element may include the base body and the metal layer that covers the base body. The base body may include the plate portion and a plurality of support columns connected to the plate portion. The plate portion may be formed by high-temperature-resistant non-metallic material. The plurality of support columns may be formed by metal material. The plate portion and the plurality of support columns may form the base body through the following two manners: (1) an insert molding manner; and (2) fixing the plate portion and the plurality of support columns together through a hot-melt process. After the base body is formed, the base body may be electroplated through the whole surface electroplating process to cause the metal layer, which is formed after the electroplating, to cover the base body. The material of the metal layer may include any one or more of Cu, Ag, Ni, and Sn. The thickness of the metal layer may be set as needed.

As shown in FIG. 1 to FIG. 3, the antenna element base plate 110 further includes two first hollow portions 110*c*, four second hollow portions 110*d*, four third hollow portions 110*e*, and eight fourth hollow portions 110*f*. The two first hollow portions 110*c* cross with each other to form a crossed groove. Two ends of each first hollow portion 110*c* are connected to two second hollow portions 110*d*, respectively. The four second hollow portions 110*d* and the two first hollow portions 110*c* form two I-shaped grooves. The structure formed by the first hollow portions 110*c* and the second hollow portions 110*d* may extend a current path to increase a radiation area of the antenna element base plate 110. Each third hollow portion 110*e* is located between two neighboring second hollow portions 110*d*. The third hollow portion 110*e* is a rectangular groove formed at the antenna element base plate 110. The third hollow portion 110*e* may have an angle of 45° with each of the two first hollow portions 110*c*. A pair of fourth hollow portions 110*f* are symmetrically arranged at two sides of each third hollow portion 110*e*. The fourth hollow portion 110*f* may be a circular slot or a circular hole formed at the antenna element base plate 110. The structure formed by the third hollow portions 110*e* and the fourth hollow portions 110*f* may optimize a feature impedance of the antenna element base plate 110 to further realize a target of broadening an operation bandwidth. In embodiments shown in FIG. 1 to FIG. 3, although the two first hollow portions 110*c* form the crossed groove, the first hollow portions 110*c* and the second hollow portions 110*d* form the I-shaped grooves, the third hollow portions 110*e* are the rectangular grooves, and the fourth hollow portions 110*f* are the circular slots or circular holes, the dimensions, shapes, quantities, and arrangement manners of the first hollow portions 110*c*, the second hollow portions 110*d*, the third hollow portions 110*e*, and the fourth hollow portions 110*f* may be designed appropriately as needed. For example, in some other embodiments, the first hollow portions 110*c*, the second hollow portions 110*d*, the third hollow portions 110*e*, and the fourth hollow portions 110*f* may be in an oval shape.

Figure 5:
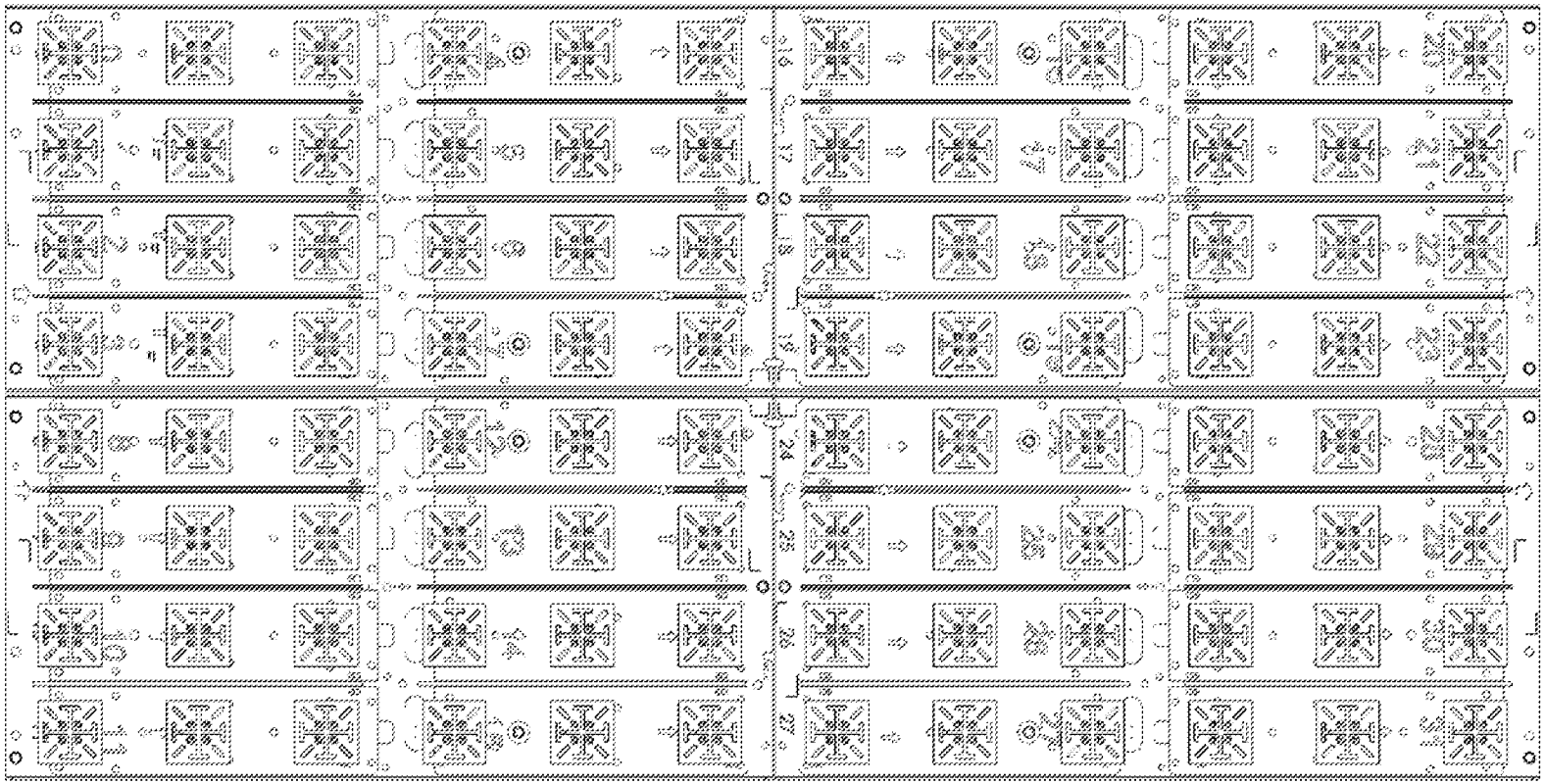
FIG. 5 is a schematic front view of an antenna according to some embodiments of the present disclosure.
Figure 6:
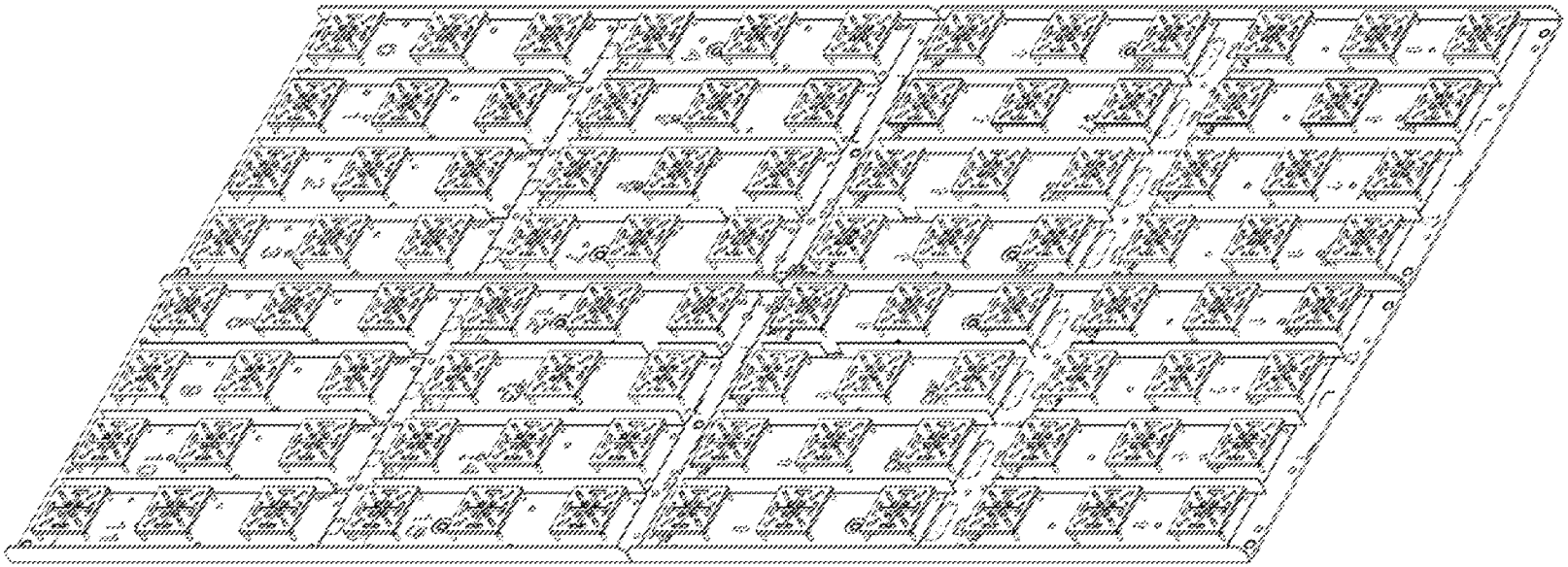
FIG. 6 is a schematic perspective view of the antenna shown in FIG. 5.

In some embodiments shown in FIG. 1 to FIG. 3, the antenna element 100 is applied to the base station antenna. For example, as shown in FIG. 5 and FIG. 6, in the base station antenna, the plurality of antenna elements 100 may be arranged at a same side of the feeder member to form an antenna element array.

In the present disclosure, the non-metallic material may be used as the base plate material of the antenna element, which has an extremely low dielectric loss. Thus, the non-metallic material may satisfy the property requirement for the material of the antenna element in the 5G communication technology, which should have a low dielectric loss and an adjustable dielectric constant. Meanwhile, by using the whole surface electroplating process, the deficiencies caused by processes of the LDS and laser activation used by the existing partial electroplating process may be avoided, which may improve the manufacturing efficiency and reduce the cost.

The above-listed are only specific embodiments of the present disclosure. The present disclosure is not limited to the above embodiments. Many similar variations may be made to embodiments of the present disclosure. All variations directly derived and thought of by those skilled in the art from the present disclosure are within the scope of the present disclosure.

What is claimed is:

1. An antenna element, comprising:

a base body including:

a plate portion formed by non-metallic material;

a support column, the support column being connected to the plate portion; and a metal layer covering the base body, wherein:

the plate portion comprises a cross-shaped hollow groove and a plurality of first straight hollow grooves;

the cross-shaped hollow groove has four arms with four corresponding endpoints; and each first straight hollow groove communicates with one of the four arms of the cross-shaped hollow groove at the corresponding endpoint, the first straight hollow groove being perpendicular to the corresponding arm of the cross-shaved hollow groove.

2. The antenna element of claim 1, wherein the support column is formed by non-metallic material.

3. The antenna element of claim 2, wherein:

the plate portion and the support column are formed by plastic; and the base body is formed through an integral injection molding manner.

4. The antenna element of claim 1, wherein the metal layer is formed through a whole surface electroplating process.

5. The antenna element of claim 4, wherein the metal layer includes at least one of Copper, Silver, Nickel, and Tin.

6. The antenna element of claim 1, wherein:

the support column is formed by metallic material; and the base body is formed by an insert molding method.

7. The antenna element of claim 1, wherein:

the support column is formed by metallic material; and the plate portion and the support column are fixed together through a hot-melt process.

8. The antenna element of claim 1, wherein:

an antenna element base plate includes the plate portion and a portion of the metal layer that covers the plate portion;

a support member includes the support column and a portion of the metal layer that covers the support column; and the support member is configured to mount the antenna element base plate at a feeder member.

9. The antenna element of claim 8, wherein:

the support member and the feeder member are connected through a welding process; and a welding material includes a low-temperature solder paste.

10. The antenna element according to claim 1, wherein the cross-shaped hollow groove is disposed at a center of the plate portion.

11. The antenna element according to claim 1, wherein:

the plate portion further comprises a plurality of second straight hollow grooves individually disposed at corners of the plate portion, each second straight hollow groove having an angle of about 45° with one of the arms of the cross-shaped hollow groove.

12. An antenna, comprising:

a plurality of antenna elements arranged in an antenna element array, each of the plurality of antenna elements including:

a base body including:

a plate portion formed by non-metallic material;

a support column, the support column being connected to the plate portion; and a metal layer covering the base body, wherein:

the plate portion comprises a cross-shaped hollow groove and a plurality of first straight hollow grooves;

the cross-shaped hollow groove has four arms with four corresponding endpoints; and each first straight hollow groove communicates with one of the four arms of the cross-shaped hollow groove at the corresponding endpoint, the first straight hollow groove being perpendicular to the corresponding arm of the cross-shaped hollow groove.

13. The antenna of claim 12, wherein the support column of each antenna element is formed by non-metallic material.

14. The antenna of claim 13, wherein for each antenna element:

the plate portion and the support column are formed by plastic; and the base body is formed through an integral injection molding manner.

15. The antenna of claim 12, wherein the metal layer of each antenna element is formed through a whole surface electroplating process.

16. The antenna of claim 15, wherein the metal layer of each antenna element includes at least one of Copper, Silver, Nickel, and Tin.

17. The antenna of claim 12, wherein for each antenna element:

the support column is formed by metallic material; and the base body is formed through an insert molding method.

18. The antenna of claim 12, wherein for each antenna element:

the support column is formed by metallic material; and the plate portion and the support column are fixed together through a hot-melt process.

19. The antenna of claim 12, wherein:

an antenna element base plate includes the plate portion and a portion of the metal layer that covers the plate portion;

a support member includes the support column and a portion of the metal layer that covers the support column; and the support member is configured to mount the antenna element base plate at a feeder member.

20. The antenna of claim 19, wherein:

the support member and the feeder member are connected through a welding process; and a welding material includes a low-temperature solder paste.

* * * * *